US008968855B2

(12) United States Patent
Hanna et al.

(10) Patent No.: US 8,968,855 B2
(45) Date of Patent: Mar. 3, 2015

(54) METHOD OF FORMING A COMPONENT HAVING AN INSERT

(75) Inventors: Michael D. Hanna, West Bloomfield, MI (US); Bob R. Powell, Jr., Birmingham, MI (US); Michael J. Walker, Windsor (CA)

(73) Assignee: GM Global Technology Operations LLC, Detroit, MI (US)

( * ) Notice: Subject to any disclaimer, the term of this patent is extended or adjusted under 35 U.S.C. 154(b) by 556 days.

(21) Appl. No.: 13/280,383

(22) Filed: Oct. 25, 2011

(65) Prior Publication Data

US 2013/0101780 A1 Apr. 25, 2013

(51) Int. Cl.

| | |
|---|---|
| ***G10K 11/16*** | (2006.01) |
| ***B32B 3/02*** | (2006.01) |
| ***B22D 19/00*** | (2006.01) |
| ***B22D 19/04*** | (2006.01) |
| ***B22D 23/02*** | (2006.01) |

(52) U.S. Cl.

CPC ..... *B22D 19/0081* (2013.01); *B22D 19/04* (2013.01); *B22D 23/02* (2013.01)

USPC ..... 428/76; 428/68

(58) Field of Classification Search

USPC ..... 428/76, 68

See application file for complete search history.

(56) References Cited

U.S. PATENT DOCUMENTS

| | | | | |
|---|---|---|---|---|
| 5,241,738 | A | 9/1993 | Colvin | |
| 8,181,690 | B2 | 5/2012 | Song et al. | |
| 2006/0076200 | A1 | 4/2006 | Dessouki et al. | |
| 2007/0012180 | A1* | 1/2007 | Miyamoto et al. | 92/171.1 |
| 2007/0056815 | A1 | 3/2007 | Hanna et al. | |
| 2007/0062664 | A1 | 3/2007 | Schroth et al. | |
| 2007/0062768 | A1 | 3/2007 | Hanna et al. | |
| 2007/0119667 | A1 | 5/2007 | Hanna et al. | |
| 2007/0298275 | A1 | 12/2007 | Carter et al. | |
| 2008/0099289 | A1 | 5/2008 | Hanna et al. | |
| 2008/0185249 | A1 | 8/2008 | Schroth et al. | |
| 2009/0020256 | A1 | 1/2009 | Hanna et al. | |
| 2009/0020383 | A1 | 1/2009 | Hanna et al. | |
| 2009/0022938 | A1 | 1/2009 | Hanna et al. | |
| 2009/0032211 | A1 | 2/2009 | Hanna et al. | |
| 2009/0032674 | A1 | 2/2009 | Hanna et al. | |
| 2009/0044923 | A1 | 2/2009 | Hanna et al. | |
| 2009/0071779 | A1 | 3/2009 | Lowe et al. | |
| 2009/0078520 | A1 | 3/2009 | Agarwal et al. | |
| 2009/0107787 | A1 | 4/2009 | Walker et al. | |
| 2009/0110901 | A1* | 4/2009 | Gaw et al. | 428/297.4 |
| 2009/0176122 | A1 | 7/2009 | Aase et al. | |
| 2009/0260931 | A1 | 10/2009 | Ulicny et al. | |
| 2009/0260932 | A1 | 10/2009 | Hanna et al. | |
| 2009/0260939 | A1 | 10/2009 | Golden et al. | |
| 2009/0269575 | A1 | 10/2009 | Hanna et al. | |
| 2010/0122880 | A1 | 5/2010 | Hanna et al. | |
| 2010/0151199 | A1* | 6/2010 | Shiao et al. | 428/144 |
| 2012/0067537 | A1 | 3/2012 | Hanna et al. | |

FOREIGN PATENT DOCUMENTS

| | | | |
|---|---|---|---|
| DE | 2458335 | A1 | 6/1976 |
| JP | 09262657 | A | 10/1997 |
| JP | 1085921 | A | 4/1998 |

* cited by examiner

*Primary Examiner* — Brent O'Hern
(74) *Attorney, Agent, or Firm* — Quinn Law Group, PLLC

(57) ABSTRACT

A component includes a cast portion and an insert. The cast portion includes a sacrificial suspension device. The insert is configured to provide damping to the component. The sacrificial suspension device is dissolved during a casting process, into a molten material, forming the cast portion such that the insert is fully encapsulated by the cast portion, including the dissolved suspension device.

12 Claims, 4 Drawing Sheets

METHOD OF FORMING A COMPONENT HAVING AN INSERT

TECHNICAL FIELD

The present disclosure relates to a component having an insert and a method of forming the component having the insert.

BACKGROUND

Motor vehicle components are commonly subjected to vibrations during the course of normal operation. Among other potential adverse affects, these vibrations may result in noise that gets transmitted into the vehicle's passenger compartment and beyond. The vibration that occurs might also lead to fatigue and failure of the components. In an effort to reduce the transmission of noise to the passenger compartment, dampers may be attached to components of the vehicle.

SUMMARY

A component includes a cast portion and an insert. The cast portion includes a sacrificial suspension device. The insert is configured to provide damping to the component. The sacrificial suspension device is dissolved during a casting process, into a molten material, forming the cast portion such that the insert is fully encapsulated by the cast portion, including the dissolved suspension device.

A method of manufacturing a component having a cast portion includes providing an insert with a body having a sacrificial suspension device operatively attached to the insert. The insert and the sacrificial suspension device are positioned in a cavity of a mold such that the sacrificial suspension device positions the body in spaced relationship to the mold. A molten material comprising a metal is cast around the body of the insert to form the cast portion such that the insert is encapsulated within the cast portion.

A damper assembly is configured for insertion into a mold for forming a cast component. The damper assembly includes an insert and a sacrificial suspension device. The insert is configured to provide damping to the component. The sacrificial suspension device is operatively attached to the insert. The sacrificial suspension device includes a melting temperature which is less than a melting temperature of the insert, such that the sacrificial suspension device is configured to be dissolved during casting of the component.

The above features and advantages and other features and advantages of the present disclosure are readily apparent from the following detailed description of the best modes for carrying out the disclosure when taken in connection with the accompanying drawings.

DETAILED DESCRIPTION

Figure 1:
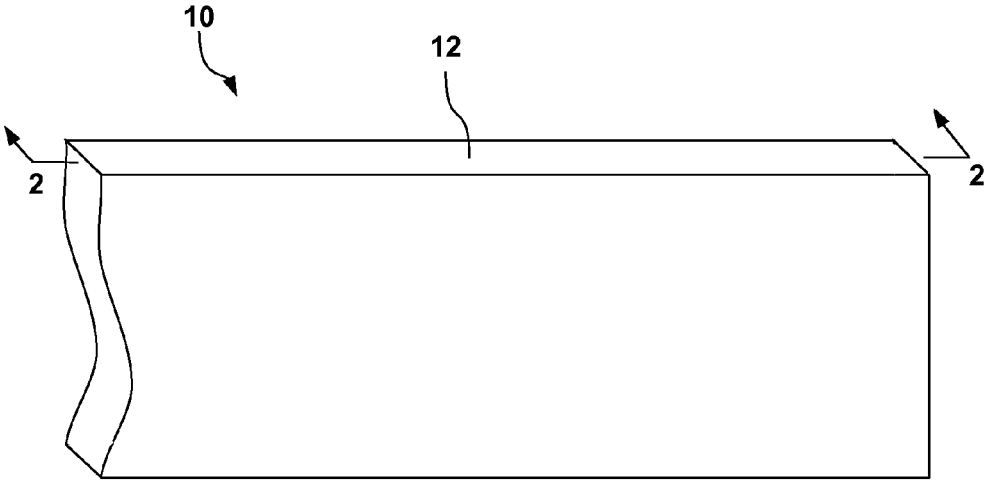
FIG. 1 is a schematic partial perspective view of a component.
Figure 2:
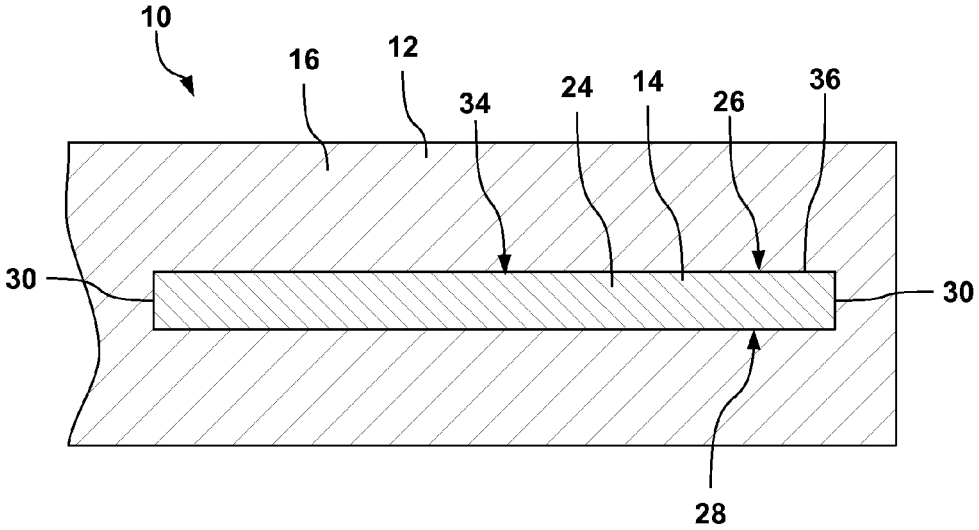
FIG. 2 is a schematic partial cross-sectional side view of the component of FIG. 1, taken along line 2-2, including an insert cast into a cast portion.

Referring to the Figures, wherein like reference numerals refer to like elements, a component 10 is shown generally at 10 in FIG. 1. Referring to FIG. 2, the component 10 includes a cast portion 12 and an insert 14.

Figure 3:
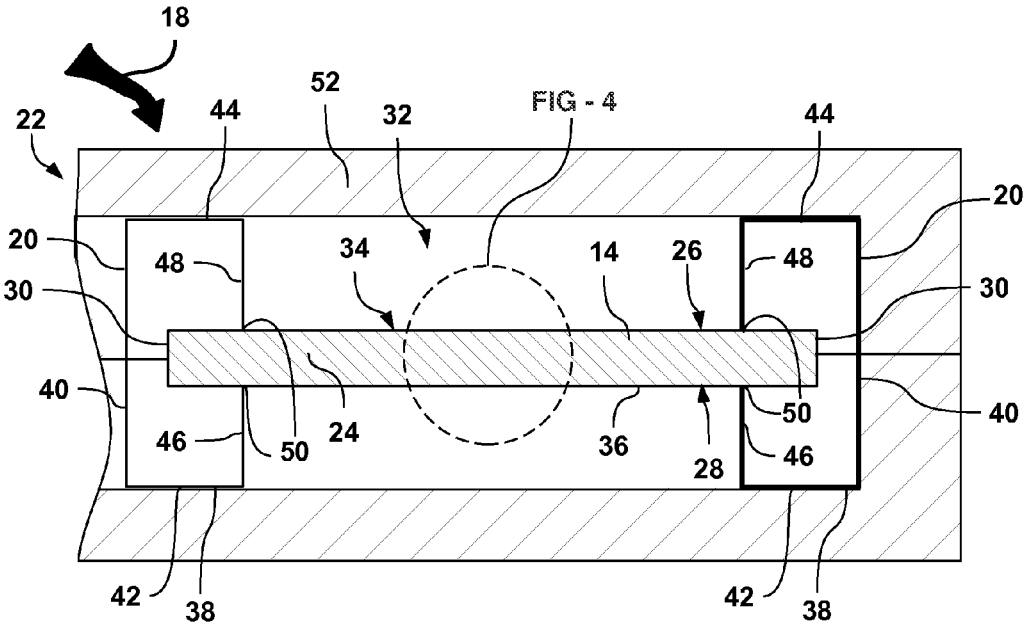
FIG. 3 is a schematic cross-sectional side view of a mold defining a cavity with a damper assembly, including the insert and a pair of sacrificial suspension devices, positioned inside the cavity.

The cast portion 12 includes a material 16 cast from a molten material 18 and a sacrificial suspension device 20, as shown in FIG. 3. The insert 14 is configured to provide damping to the component 10. Referring again to FIG. 2, the insert 14 is completely encapsulated, or otherwise hermetically sealed, within the cast portion 12. The inserts 14 may be cast-in-place (CIP) inserts which are cast within the cast portion 12 using high pressure die casting.

A damper assembly 22 is provided for insertion into a mold 52 to cast the component 10 from the molten material 18. The damper assembly 22 includes the insert 14 and the sacrificial suspension device 20, operatively attached to the insert 14. The sacrificial suspension device 20 is configured to secure and position the insert 14 within the mold 52. The sacrificial suspension device 20 may be more than one sacrificial suspension device 20. The sacrificial suspension device 20 includes a metal which has a melting temperature that is no greater than a melting temperature of the material 16 of the cast portion 12 and less than a melting temperature of the insert 14. This allows the sacrificial suspension devices 20 to be consumed, or otherwise dissolved within the molten material 18, during casting of the component 10, while preventing the insert 14 from being melted by the molten material 18. Said differently, the melting temperature of the sacrificial suspension device 20 is no greater than the melting temperature of the material 16 so that the sacrificial suspension device 20 is melted by the molten material 18, i.e., after the material 16 has reached its melting temperature, and the sacrificial suspension device 20 is consumed by the molten material 18. Since the sacrificial suspension device 20 is formed from the same material 16 as the molten material 18, issues relating to using dissimilar materials, such as the coefficients of thermal expansion, thermal conductivity changes, differential frictional characteristics, and any other operational issues, are eliminated. The sacrificial suspension devices 20 can be produced via extrusion or other methods, such as die casting and the like.

The sacrificial suspension device 20 is configured to hold or position the insert 14 in spaced relationship to the mold 52 such that the molten material 18 can flow about the entire insert 14 as the component 10 is being cast. As a result, the insert 14 is fully encapsulated, or otherwise hermetically sealed, by the cast portion 12, including the dissolved suspension device 20. Therefore, the sacrificial suspension devices 20 position the insert 14 to a desired location within the cast portion 12.

The component 10 is formed by positioning the damper assembly 22 in the cavity 32 of the mold 52 such that the sacrificial suspension device(s) 20 hold, or otherwise position, the body 24 in spaced relationship to the mold 52. The molten material 18 is cast around the insert 14 to form the cast portion 12. As the molten material 18 flows around the insert 14, the molten material 18 melts the suspension device such that the suspension device becomes entirely dissolved by the molten material 18. After casting, the insert 14 is entirely encapsulated within the cast portion 12. The enclosure of the insert 14 inside the cavity 32 of the mold 52 can prevent extension of the insert 14 outside the component. No additional features are necessary to the mold 52 in order to accommodate the insert 14.

Figure 4:
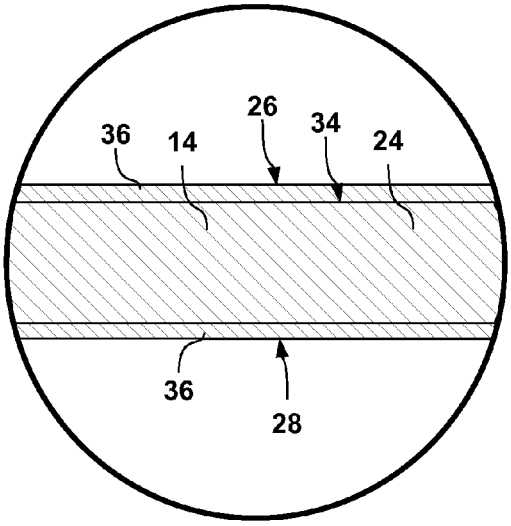
FIG. 4 is an enlargement of the area "FIG. 4," as provided in FIG. 3.
Figure 5:
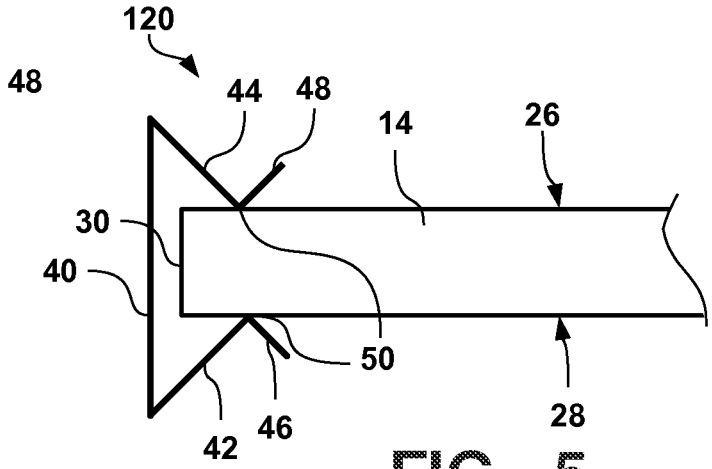
FIG. 5 is a schematic partial side view of another embodiment of the damper assembly with an alternative sacrificial suspension device attached to the insert.

Referring to FIGS. 3 and 4, the insert 14 extends between a pair of ends 30 and presents a first face 26 and a second face 28, opposite the first face 26. The insert 14 also includes a body 24 which presents an exterior surface 34. A coating 36 is disposed on the exterior surface 34 and completely covers the exterior surface 34 of the body 24. Therefore, the coating 36 is disposed between the cast portion 12 and the body 24 of the insert 14 once the component 10 is cast. The coating 36 may be about 5 micrometers (μm) to about 500 μm thick and comprises a plurality of particles, flakes, fibers, and the like. The coating 36 may include silica, alumina, graphite with clay, silicon carbide, silicon nitride, cordierite (magnesium-iron-aluminum silicate), mullite (aluminum silicate), zirconia (zirconium oxide), phyllosilicates, other high-temperature-resistant particles, clay, Al2O3, SiO2, a lignosulfonate binder, a calcium lignosulfonate binder, cristobalite (SiO2), a fiber, a ceramic fiber, a mineral fiber, quartz, an epoxy resin, a phosphoric acid binding agent, calcium aluminates, sodium silicates, wood flour, non-refractory polymeric materials, ceramics, composites, wood, a liquid dispersed mixture of alumina-silicate-based, organically bonded refractory mix, and the like.

At least a portion of the coating 36 may have a melting temperature which is greater that a melting temperature of the material 16 of the cast portion 12. This higher melting temperature may prevent the coating 36 from being consumed by, or otherwise dissolved within, the molten material 18 during the casting process.

The body 24 of the insert 14 may include titanium, steel, stainless steel, cast iron, aluminum, magnesium, zinc, and/or the like.

The sacrificial suspension device 20 may be formed by extrusion and subsequent assembly by bending materials, casting, and the like. A distance between the contact points 50 may be changed to enable a range of insert 14 thicknesses (including coatings 36), sizes and shapes of inserts 14, and locations of inserts 14 within the cavity 32. As discussed above, the sacrificial suspension device 20 may be formed of the material 16 to be cast so that the sacrificial suspension device 20 will diffusion bond to the solidifying metal (cast portion 12) during casting and ensure a high integrity casting.

Referring again to FIG. 3, the sacrificial suspensions device may be operatively attached to the insert 14, proximate a respective end 30 of the insert 14. The sacrificial suspension device 20 may be a spring clip 38 having a general rectangular or square shape and including a metal. The sacrificial suspension device 20 includes a first side 40, a second side 42, a third side 44, a first finger 46, and a second finger 48. The second side 42 and the third side 44 extend generally perpendicularly from the first side 40 in spaced and generally parallel relationship to one another. The first finger 46 extends generally perpendicularly from the second side 42, toward the third side 44. The second finger 48 extends generally perpendicularly from the third side 44, toward the second side 42. Therefore, the first finger 46 and the second finger 48 may be collinear and extend in spaced and generally parallel relationship to the first side 40. The first finger 46 and the second finger 48 each terminate at a respective contact point 50. The spring clip 38 is in clamping engagement with the insert 14 such that the contact point 50 of the second finger 48 engages the first face 26 and the contact point 50 of the first finger 46 engages the second face 28 to retain the insert 14 therebetween. Therefore, each finger 46, 48 is configured to position the respective first side 40 and second side 42 of the insert 14 in spaced relationship to the mold 52. Additionally, in order to space the ends 30 of the insert 14 from the mold 52 such that the insert 14 can be completely encapsulated within the cast portion 12 after casting, the first side 40 of the sacrificial suspension device 20 may be spaced from respective end 30 of the insert 14.

By way of non-limiting examples, FIGS. 5-9 illustrate that the sacrificial suspension device 20 may be formed in different shapes as well as that which is illustrated in the previous Figures. The sacrificial suspension device 120 of FIG. 5 includes the first side 40, the second side 42, the third side 44, the first finger 46, and the second finger 48. The second side 42 and the third side 44 extend from the first side 40 in converging relationship to one another and each side 42, 44 terminates at a respective contact point 50. The first finger 46 extends from the second side 42, away from the first side 40, such that the second side 42 and the first finger 46 combine to present an L-shape. The second finger 48 extends from the third side 44, away from the first side 40, such that the third side 44 and the second finger 48 combine to present an L-shape. Therefore, the first finger 46 and the second finger 48 extend from the respective second side 42 and third side 44 in diverging relationship to one another. The sacrificial suspension device 120 is in clamping engagement with the insert 14 such that the contact points 50 engage the faces 26, 28 to retain the insert 14 therebetween.

Figure 6:
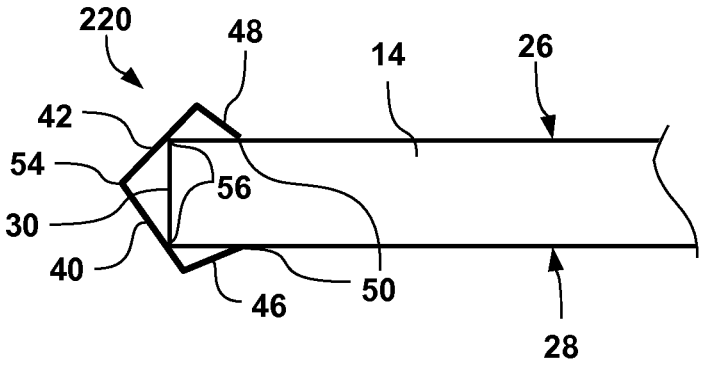
FIG. 6 is a schematic partial side view of another embodiment of the damper assembly with an alternative sacrificial suspension device attached to the insert.

The sacrificial suspension device 220 of FIG. 6 includes a first side 40, a second side 42, a first finger 46, and a second finger 48. The first side 40 extends in diverging relationship to the second side 42 such that a vertex 54 is defined between the first side 40 and the second side 42. The first finger 46 extends from the first side 40 and the second finger 48 extends from the second side 42 such that the first finger 46 and the second finger 48 extend in converging relationship to one another. Additionally, the first finger 46 and the second finger 48 each terminate at a respective contact point 50. The sacrificial suspension device 220 is in clamping engagement with the insert 14 such that the contact points 50 engage the respective corresponding faces 26, 28 to retain the insert 14 therebetween. Additionally, in order to more precisely locate the sacrificial suspension device 220 onto the insert 14, the sacrificial suspension device 220 may be positioned such that each of the first side 40 and second side 42 contacts the insert 14 at a respective locating point 56 and the vertex 54 is disposed in spaced relationship to the respective end 30 of the insert 14.

Figure 7:
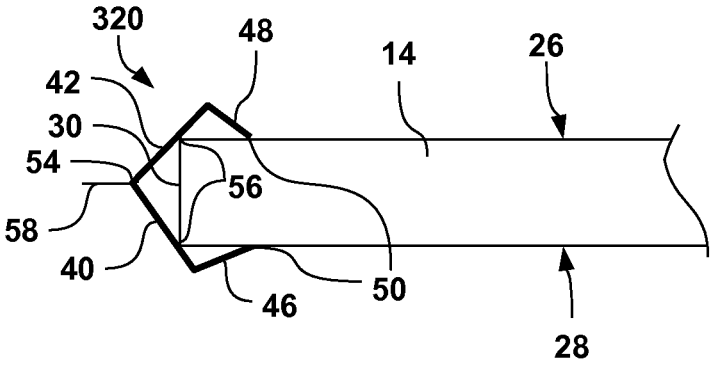
FIG. 7 is a schematic partial side view of another embodiment of the damper assembly with an alternative sacrificial suspension device attached to the insert.

The sacrificial suspension device 320, shown in FIG. 7, may be identical to that which is shown in FIG. 6, except that a nose 58 extends from the vertex 54, opposite each of the first finger 46 and the second finger 48. The nose 58 may be configured to index off of the mold 52 to more precisely position the insert 14 in spaced relationship to the mold 52, within the cavity 32.

Figure 8:
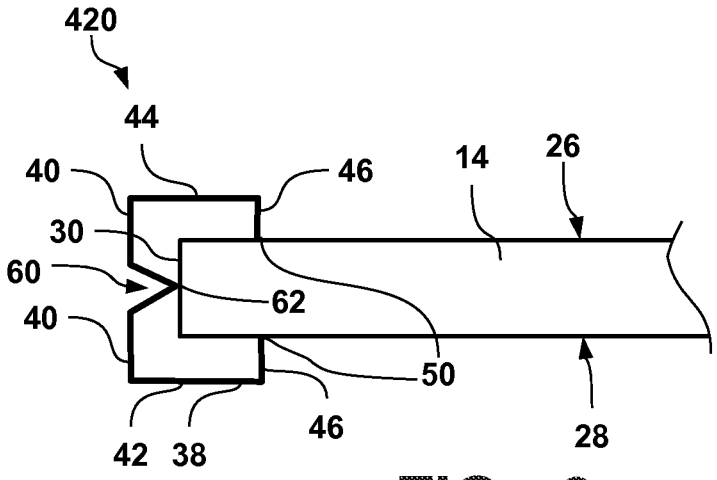
FIG. 8 is a schematic partial side view of another embodiment of the damper assembly with an alternative sacrificial suspension device attached to the insert.
Figure 9:
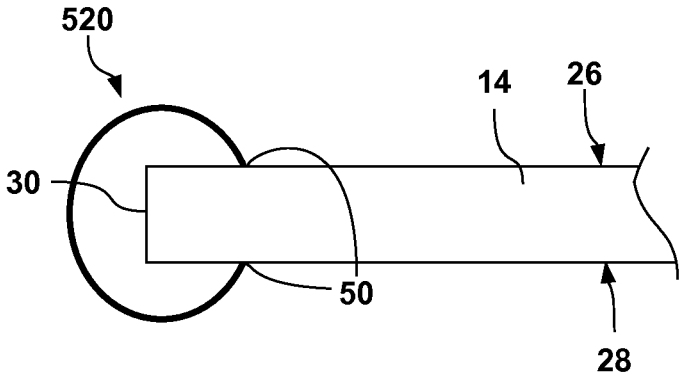
FIG. 9 is a schematic partial side view of yet another embodiment of the damper assembly with an alternative sacrificial suspension device attached to the insert.

Referring to FIG. 8, the sacrificial suspension device 420 may be similar to the sacrificial suspension device 20 shown in FIG. 3, except that a V-shaped notch 60 may be defined by the first side 40. The V-shaped notch 60 may extend from the first side 40, between the second side 42 and the third side 44, and terminate at an indexing point 62. The sacrificial suspension device 420 may be attached to the insert 14 such that the indexing point 62 contacts the respective end 30 of the insert 14. This ensures that the first side 40 is spaced more precisely from the respective end 30.

The sacrificial suspension device 520 of FIG. 8 may be generally C-shaped. The sacrificial suspension device 20 terminates at a pair of contact points 50 that are biased toward one another. It should be appreciated that sacrificial suspension devices 520 having other shapes and configurations may also be used such that the insert 14 is spaced from the mold 52.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A component comprising:

a cast portion; and an insert configured to provide damping to the component;

wherein the position of the insert relative to the cast portion is defined by a sacrificial suspension device at least partially dissolved into the cast portion;

wherein the insert includes a body presenting an exterior surface and a coating disposed on the exterior surface such that the coating is disposed between the cast portion and the body of the insert; and wherein the insert is fully encapsulated by the cast portion.

2. A component, as set forth in claim 1, wherein the suspension device is a first suspension device and a second suspension device, spaced from the first suspension device.

3. A component, as set forth in claim 1, wherein the insert is hermetically sealed within the cast portion, including the dissolved suspension device.

4. A component, as set forth in claim 1, wherein the coating completely covers the body.

5. A component, as set forth in claim 1, wherein the coating is about 5 μm to about 500 μm thick.

6. A component, as set forth in claim 1, wherein the coating comprises at least one of a plurality of particles, flakes, and fibers.

7. A component, as set forth in claim 1, wherein the coating comprises at least one of silica, alumina, graphite with clay, silicon carbide, silicon nitride, cordierite (magnesium-iron-aluminum silicate), mullite (aluminum silicate), zirconia (zirconium oxide), phyllosilicates, other high-temperature-resistant particles, clay, $Al_2O_3$, $SiO_2$, a lignosulfonate binder, a calcium lignosulfonate binder, cristobalite ($SiO_2$), a fiber, a ceramic fiber, a mineral fiber, quartz, an epoxy resin, a phosphoric acid binding agent, calcium aluminates, sodium silicates, wood flour, non-refractory polymeric materials, ceramics, composites, wood, and a liquid dispersed mixture of alumina-silicate-based, organically bonded refractory mix.

8. A component, as set forth in claim 1, wherein at least a portion of the coating has a melting temperature which is greater that a melting temperature of the material.

9. A component, as set forth in claim 1, wherein the body comprises at least one of titanium, steel, stainless steel, cast iron, aluminum, magnesium, and zinc.

10. A damper assembly configured for insertion into a mold for casting molten material about the damper assembly to form a cast component, the damper assembly comprising:

an insert configured to provide damping to the component; and a sacrificial suspension device operatively attached to the insert;

wherein the sacrificial suspension device is configured to allow the insert to be positioned in spaced relationship to the mold such that molten material can flow about the entire insert to fully encapsulate the insert; and wherein the sacrificial suspension device exhibits a melting temperature which is less than a melting temperature of the insert, such that the sacrificial suspension device is configured to be dissolved during casting of the component.

11. A damper assembly, as set forth in claim 10, wherein the sacrificial suspension device is a spring clip including a metal.

12. A damper assembly, as set forth in claim 11, wherein the insert includes a body presenting an exterior surface and a coating disposed on the exterior surface such that the coating is disposed between the material and the body of the insert;

wherein the body includes a first face and a second face, opposite the first face;

wherein the suspension device extends between a first finger and a second finger, extending toward the first finger;

wherein the spring clip is in clamping engagement with the insert such that the first finger engages the first face and the second finger engages the second face to retain the insert therebetween.

* * * * *